US005347912A

United States Patent [19]

Gathoye

[11] Patent Number: 5,347,912

[45] Date of Patent: Sep. 20, 1994

[54] ELEMENTS FOR DECELERATING THE RECOIL OF THE MOVING PARTS OF A FIRE ARM

[75] Inventor: Jean-Louis Gathoye, Argenteau, Belgium

[73] Assignee: Fabrique Nationale Nouvelle Herstal, en abrégé FNNH, société anonyme, Herstal, Belgium

[21] Appl. No.: 66,217

[22] Filed: May 25, 1993

[30] Foreign Application Priority Data

Jun. 3, 1992 [BE] Belgium ..... 09200508

[51] Int. Cl.[5] ..... F41A 5/08

[52] U.S. Cl. ..... 89/169

[58] Field of Search ..... 89/169

[56] References Cited

U.S. PATENT DOCUMENTS

| | | | |
|---|---|---|---|
| 1,431,979 | 10/1922 | Pomeroy | 89/170 |
| 1,985,493 | 12/1934 | Gebauer et al. | 89/169 |
| 2,705,847 | 4/1955 | Kramer | 42/7 |
| 2,921,503 | 1/1960 | Browning | 89/195 |

FOREIGN PATENT DOCUMENTS

| | | | |
|---|---|---|---|
| 494997 | 3/1930 | Fed. Rep. of Germany | 89/169 |
| 13045 | of 1901 | United Kingdom | 89/169 |
| 240880 | 1/1927 | United Kingdom . | |

*Primary Examiner*—Stephen C. Bentley
*Attorney, Agent, or Firm*—Foley & Lardner

[57] ABSTRACT

Elements for decelerating the recoil of the moving parts of a fire arm of the type with a casing (12) having mobile moving parts (3) bearing a mobile barrel (4) and a striker (13), whereby the drive element of said striker (13) consists of a kinematic chain (15) containing a trigger (16) revolving in the casing (12), characterized in that between the moving parts (3) and the barrel (4) a lever (1) hinged in the casing (12) is activated, whereby this lever (1) has a stop (6) towards the front making contact with a surface (5) of the moving parts (3) during only part of the recoil of said moving parts (3) whereby this recoil causes the lever (1) to revolve until it no longer makes contact with the surface (5), whereby this lever (1) also has a stop (9) towards the end making contact with a surface (8) of the barrel (4), such that during said revolving motion, the barrel (4) follows the recoil of the moving parts (3), but at a lower speed with regard to the lever L2/L1.

18 Claims, 3 Drawing Sheets

ELEMENTS FOR DECELERATING THE RECOIL OF THE MOVING PARTS OF A FIRE ARM

The present invention concerns elements for decelerating the recoil of the slide of a fire arm whereby said decelerating is obtained in particular by moving the barrel of the firearm backwards simultaneously with the recoil of the slide.

The invention operates based on a working principle according to which the barrel is neither fixed in the casing (which is the case according to the blow-back principle), nor solid with the breech (which is the case, for the first millimeters of the recoil, according to the short recoil principle) of the gun.

The blow-back principle has 2 disadvantages in that it requires a heavier weight of the slide, such that the firearm has a heavy weight, whereas the short recoil principle has 2 disadvantages in that it requires a bolt element for the slide with regard to the barrel, such that the slide can be interlocked with the barrel as the slide begins to recoil so as to release the slide from the barrel after a very short time, whereby such element has a complicated construction. Moreover, its operation for certain types of cartridges makes it necessary to provide slides having such a light mass that they are just impossible to realize.

The invention provides elements for decelerating the recoil of the slide of a firearm, for example a pistol, to remedy these disadvantages.

According to the invention, this aim is achieved by means of elements for decelerating the recoil of the slide of a fire arm of the type with a casing a mobile slide bearing a mobile barrel and a striker, whereby the drive element of said striker consists of a kinematic chain containing a trigger revolving in the casing, characterized in that between the slide and the barrel a lever hinged in the casing is activated, whereby this lever has a stop towards the front making contact with a surface of the slide during only part of the recoil of said slide, whereby this recoil causes the lever to revolve until it no longer makes contact with the surface, whereby this lever also has a stop towards the end making contact with a surface of the barrel, such that during said revolving motion, the barrel follows the recoil of the slide, but at a lower speed with regard to the lever.

In order to better explain the characteristics of the invention, by way of example only and without being limitative in any way, an example of the realization of elements according to the invention is described hereafter with reference to the accompanying drawings, where:

Figure 1:
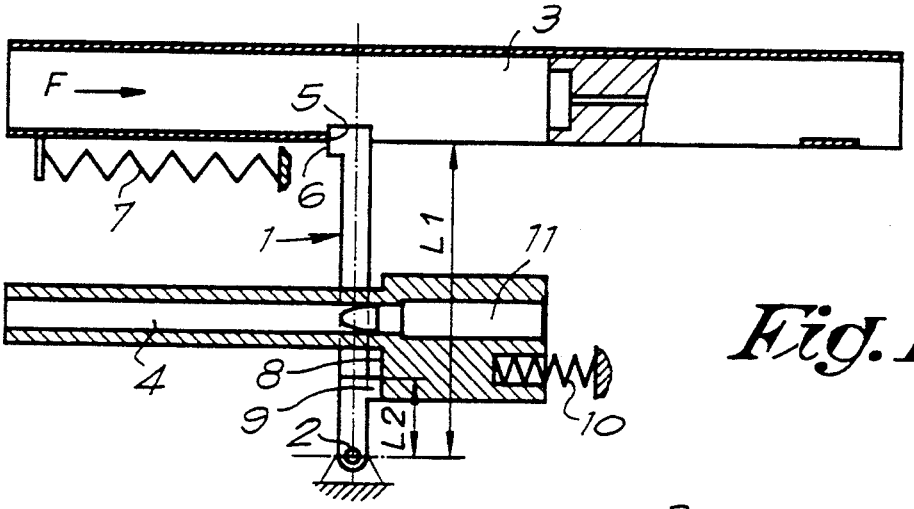
FIG. 1 is a very concise representation of the elements according to the invention.
Figure 2:
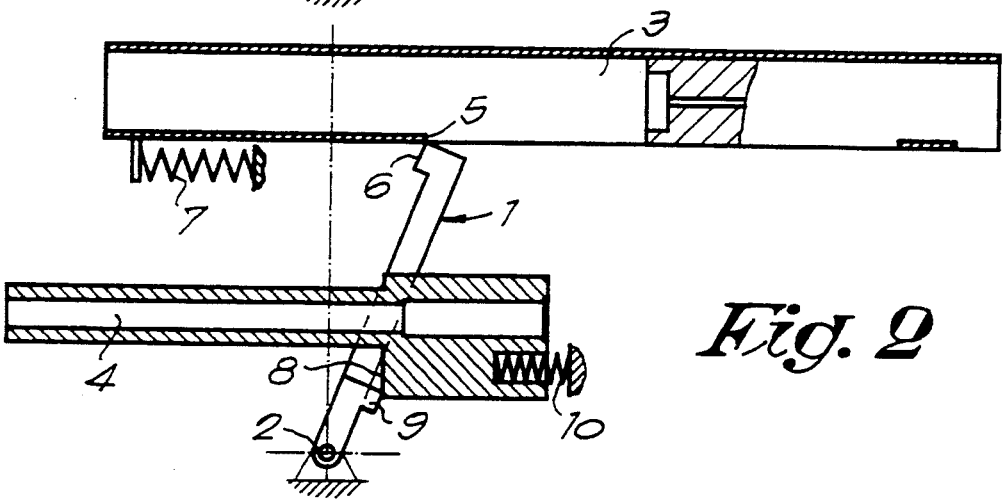
FIGS. 2 and 3 represent similar views as those of FIG. 1, whereby the elements according to the invention are placed in two other typical positions.
Figure 3:
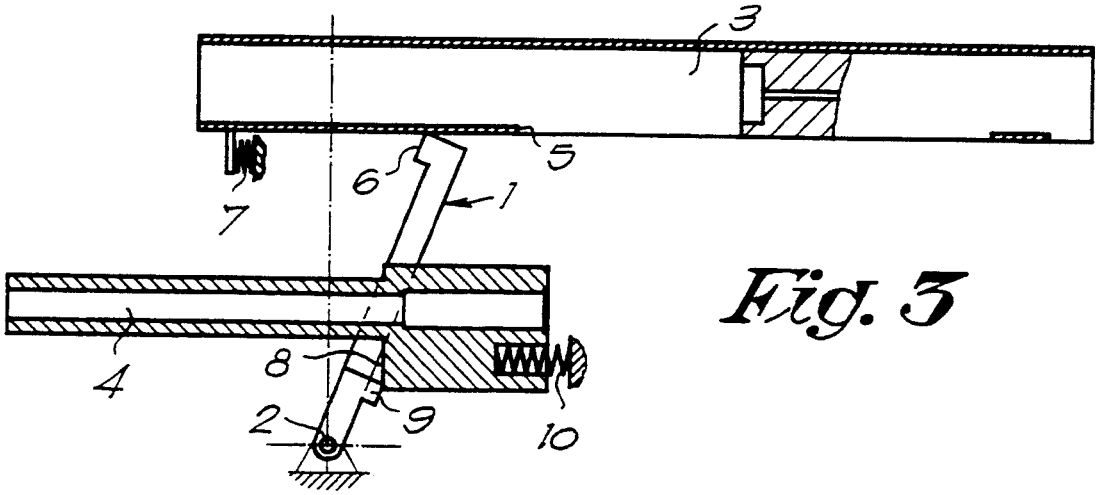

FIGS. 1 to 3 are schematic representations of the elements according to the invention, which mainly consist of a lever 1 hinged around an axis 2, whereby said lever 1 is activated between the slide 3 and the barrel 4 of a firearm.

In FIG. 1, the firearm is in a rest position. The slide 3 is stopped against the rear face of the barrel 4 by means of a spring 7. The conjoint movement to the front, caused by the release spring 10 and the inertia of the slide 3 and the barrel 4, is stopped when the lever 1 is moved up again, which is finally brought to a standstill as its stop 6 rests on the surface 5 of the slide 3 on the one hand and as its stop 9 rests on the surface 8 of the barrel 4 on the other hand. The barrel 4 contains the bullet 11.

The stop 6 is situated at a distance L1 from the axis 2 whereas the stop 9 is situated at a distance L2 from said axis.

At the time of shooting, the slide 3 becomes subject, in a conventional manner, to a recoil force F caused by the pressure. According to the invention, the slide 3 transmits this strain via the surface 5 onto the stop 6 of the lever 1. The latter, revolving around its hinge axis 2, pushes with its stop 9 against the surface 8 of the barrel 4, thus also carrying along the barrel 4 towards the rear.

From the above it is clear that the recoil of the slide 3 is decelerated not only by the mass itself of the slide 3, but also by the mass of the barrel 4.

Said barrel moves to the rear as the recoil starts, but at a lower speed than the slide, theoretically represented by the ratio L2/L1.

Moreover, in the case of firearms using cartridges with a neck, the slide also decelerated due to the propulsive force as a result of the pressures prevailing in the chamber.

This situation lasts until the position is reached in which the free end of the lever 1 is rocked under the slide 3, as represented in FIG. 2, after which the decelerating of the slide 3 continues under the sole influence of the mass of the slide 3 and the growing effort developed by the spring 7. The mass of the barrel 4 at this moment no longer has any effect on the deceleration of the slide 3. This situation is schematically represented in FIG. 3.

FIGS. 4 to 7 represent a firearm, more in particular a pistol using the elements as represented in FIGS. 1 to 3.

This pistol mainly consists of a casing 12 carrying the slide 3 which in turn supports the barrel 4 as well as the striker 13.

A hammer 14 revolving in the casing 12 may knock against said striker 13 under the impact of a spring, not represented in the drawings, with the help of a kinematic chain schematically represented by 15 containing among other things the trigger 16 which may tilt around the axis 17.

The barrel 4 has a heel 18 in which a recessed hole 19 is provided containing a spring 20 of which the rear end rests on the casing 12.

In front of the heel 18 is situated the element according to the invention composed of the lever 1 which is hinged on the axis 2 provided in the casing 12.

Said lever 1 mainly consists of a U-shaped element whose central part 21 forms, towards the back, the stop 9 which makes contact with the surface 8 of the heel 18 of the barrel 4 whereas the wings 22 and 23 of the lever 1 together form, towards the front, the stop 6 which makes contact with the surface 5 of the slide, in this case internal ribs 24, 25 of the slide 3.

The working of the arm as represented in FIGS. 4 to 7 is simple and as follows.

Figure 4:
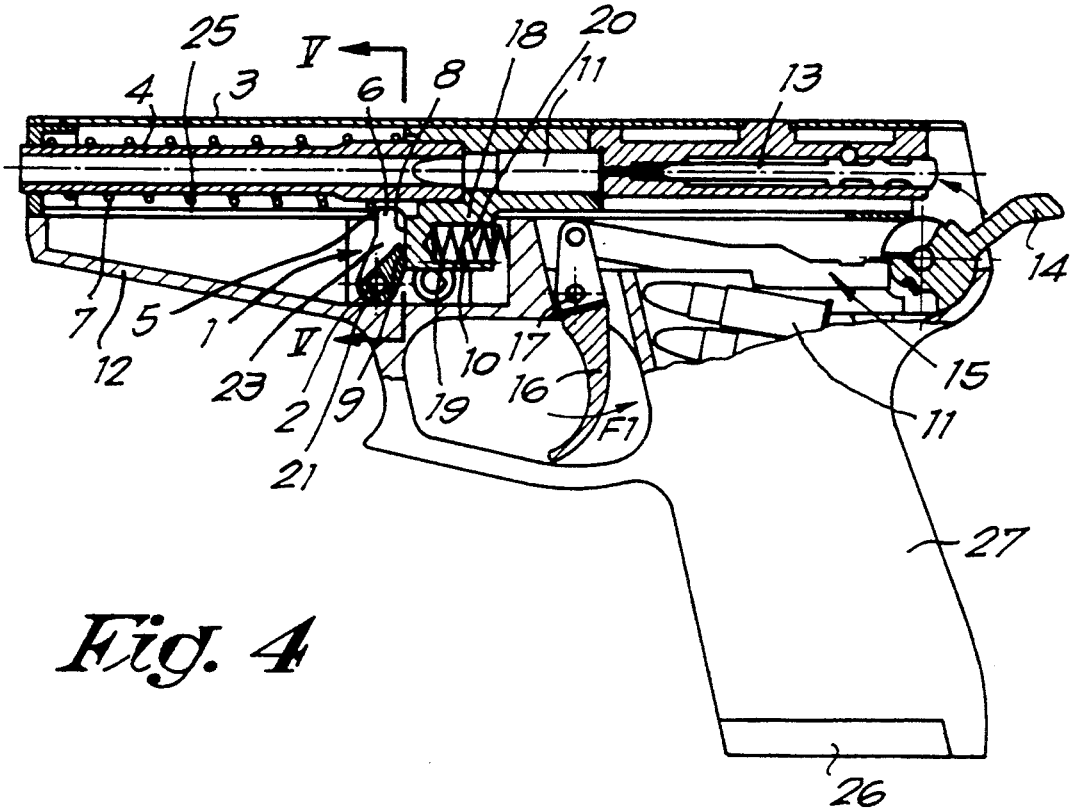
FIG. 4 represents a longitudinal, partial section of a firearm, in this case a pistol, in which the elements according to the invention are applied, whereby the arm is represented when loaded.
Figure 5:
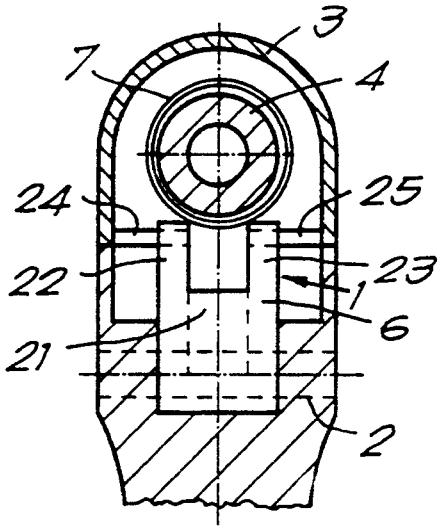
FIG. 5 represents a section according to line V—V of FIG. 4, to a larger scale.
Figure 6:
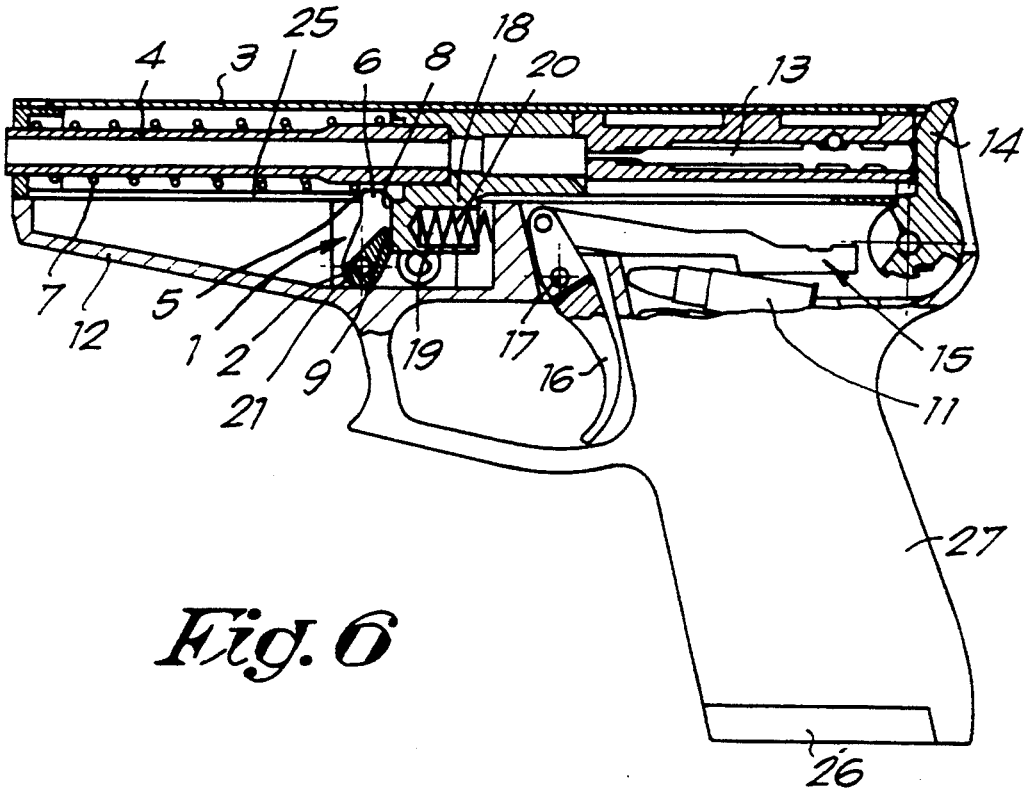
FIGS. 6 and 7 represent views similar to those in FIG. 4 for two other typical positions of the arm.

After the loader 26 has been introduced in the grip 27 the firearm, bullet 11 is led into the chamber of the barrel 4 by means of a known manual manipulation of the slide 3, which also has as an effect that the hammer 14 is armed as represented in FIG. 4.

The thus prepared arm is ready for shooting. The movement of the trigger 16 in the direction of the arrow F1 has for an effect, via the kinematic chain 15, that the hammer 14 is released such that it is driven against the striker 13 (see FIG. 6).

Following the departure of the bullet 11 and under the influence of the explosion, the slide 3 is driven backwards, and its movement has for an effect that the lever 1 tilts around its hinge axis 2 due to the effect of the ribs 24, 25 on the wings 22, 23 of said lever 1.

As the lever is situated between the slide 3 and the barrel 4, the latter follows the movement of the slide 3 due to the fact that the central part 21 of said lever 1 strikes against the heel 18 of the barrel 4.

Figure 7:
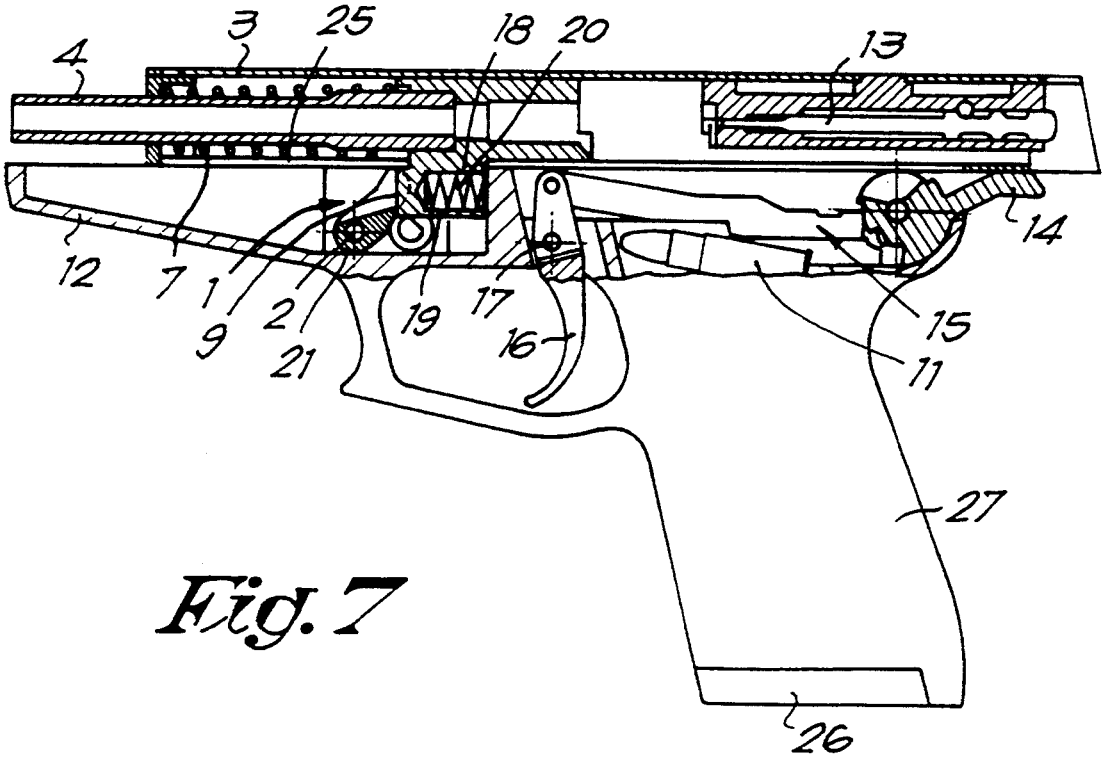

Thus, at this moment, the mass of the barrel 4 as well as the forward thrust in the case of cartridges with a neck work in conjunction with the mass of the slide 3, so as to decelerate the latter, until the lever 1 has tilted into the position as represented in FIG. 7, a position in which the free ends of the wings 22 and 23 of the lever 1 are positioned under the ribs 24, 25 of the slide whereas the free end of the central part 21 of the lever 1 still remains against the heel 18 of the barrel 4 which is held back, by the other rear end of said heel, against the casing 12 of the firearm, the spring 20 being compressed.

The slide 3 alone continues its backward movement so as to eject the case of the fired bullet; so as to drive back the hammer 14; so as to put the spring, not represented in the figures and connected to the hammer, under tension; and so as to recharge the chamber of the barrel 4 with a new bullet 11 coming from the loader 26.

Finally, the slide 3 is put back into contact, towards the front, with the barrel by means of the spring 7 so as to regain the position of FIG. 4, pushed by the spring 20.

During the forward movement of the slide 3, the lever 1 regains its position between the slide 3 and the barrel 4.

It is clear that the ratio L1/L2 of the lever 1 depends on the ammunition used.

Thus, the elements according to the invention have a very simple construction, which provides great working security. Moreover, these elements are advantageous that, at any moment of the kinematic cycle, the moving pieces (barrel 4 and slide 3) are perfectly aligned, which allows for a minimal and regular wear of the slide 3 and the barrel 4 among themselves and with regard to the casing 12.

It is clear that the invention is in no way limited to the embodiment described above; on the contrary, all sorts of modifications can be made to the above-described elements while still remaining within the scope of the invention.

I claim:

1. The combination in a firearm comprising:

a casing;

a slide movably guided on the casing and having a front end and a rear end and presenting a surface directed toward the rear end, the slide having a recoil movement toward the rear end upon firing;

a barrel movably mounted along the slide and presenting a surface directed toward the front end of the slide;

a firing device comprising a striker and a kinematic chain for activating the striker, the chain comprising a trigger pivotably mounted in the casing; and means for decelerating the slide, the means comprising a lever hingedly mounted around a hinging axis on the casing between the barrel and the slide, the lever being provided with a first stop and a second stop on two opposite sides, the first stop being situated on a side of the lever directed toward the front end of the slide and being adapted to make contact with the surface of the slide during only a part of the recoil movement of the slide, the second stop being situated at the opposite side of the lever directed toward the rear end of the slide and being adapted to come into contact with the surface of the barrel, the first stop being a distance from the hinging axis which is greater than a distance between the second stop and the hinging axis.

2. The combination of claim 1, wherein the first stop is adapted to come into contact with the surface of the slide at the beginning of the recoil of the slide.

3. The means for slide deceleration of claim 1, wherein the first stop is situated at a free end of the lever while the second stop is situated between the free end and the hinging axis.

4. The means for slide deceleration of claim 1, wherein the lever has a rest position in which the stops are simultaneously in contact with the surface of the slide and the surface of the barrel.

5. The combination of claim 1, further comprising a spring between the slide and the casing, wherein the spring maintains the surface of the slide against the first stop of the lever when the firearm is in a rest position.

6. The combination of claim 1, further comprising a spring between the barrel and the casing pushing the surface of the barrel against the second stop of the lever when the firearm is in a rest position.

7. The combination of claim 1, wherein the barrel comprises a heel, the surface of the barrel being situated on the heel.

8. The combination of claim 1, wherein the slide is provided with ribs, the surface of the slide being formed by the ribs.

9. The means for slide deceleration of claim 1, wherein the lever consists of a U-shaped element and comprises a central part and two wings projecting from the central part, the first stop being formed by the wings, the second stop being formed by the central part.

10. The combination in a firearm comprising:

a casing;

a slide movably guided on the casing and having a front end and a rear end and presenting a surface directed toward the rear end, the slide having a recoil movement toward the rear end upon firing;

a barrel movably mounted along the slide and presenting a surface directed toward the front end of the slide;

a firing device comprising a striker and a kinematic chain for activating the striker, the chain comprising a trigger pivotably mounted in the casing; and a slide decelerator comprising a lever hingedly mounted around a hinging axis on the casing between the barrel and the slide, the lever being provided with a first stop and a second stop on two opposite sides, the first stop being situated on a side of the lever directed toward the front end of the slide and being adapted to make contact with the surface of the slide during only a part of the recoil movement of the slide, the second stop being situated at the opposite side of the lever directed toward the rear end of the slide and being adapted to come into contact with the surface of the barrel, the first stop being a distance from the hinging axis which is greater than a distance between the second stop and the hinging axis.

11. The combination of claim 10, wherein the first stop is adapted to come into contact with the surface of the slide at the beginning of the recoil of the slide.

12. The combination of claim 10, wherein the first stop is situated at a free end of the lever while the second stop is situated between the free end and the hinging axis.

13. The combination of claim 10, wherein the lever has a rest position in which the stops are simultaneously in contact with the surface of the slide and the surface of the barrel.

14. The combination of claim 10, further comprising a spring between the slide and the casing, wherein the spring maintains the surface of the slide against the first stop of the lever when the firearm is in a rest position.

15. The combination of claim 10, further comprising a spring between the barrel and the casing pushing the surface of the barrel against the second stop of the lever when the firearm is in a rest position.

16. The combination of claim 10, wherein the barrel comprises a heel, the surface of the barrel being situated on the

17. The combination of claim 10, wherein the slide is provided with ribs, the surface of the slide being formed by the ribs.

18. The combination of claim 10, wherein the lever consists of a U-shaped element and comprises a central part and two wings projected from the central part, the first stop being formed by the wings, the second stop being formed by the central part.

* * * * *